United States Patent [19]

Kaplan

[11] 4,140,476

[45] Feb. 20, 1979

[54] ENERGY-EFFICIENT OIL BURNER

[75] Inventor: Robert A. Kaplan, Fort Wayne, Ind.

[73] Assignee: Wayne Home Equipment Company, Fort Wayne, Ind.

[21] Appl. No.: 820,084

[22] Filed: Jul. 29, 1977

[51] Int. Cl.[2] ..... F23Q 3/00

[52] U.S. Cl. ..... 431/265; 431/74

[58] Field of Search ..... 431/265, 89, 12, 71, 431/74; 310/172

[56] References Cited

U.S. PATENT DOCUMENTS

| | | | |
|---|---|---|---|
| 2,815,460 | 12/1967 | Jones et al. | 310/172 |
| 3,169,571 | 2/1965 | Madsen | 431/265 |
| 3,255,804 | 6/1966 | Lang | 431/265 X |
| 3,606,608 | 9/1971 | Miller et al. | 431/265 X |

*Primary Examiner*—Edward G. Favors

*Attorney, Agent, or Firm*—Gust, Irish, Jeffers & Rickert

[57] ABSTRACT

A gun-type burner including a housing having side and end walls defining a plenum chamber. A blast tube is mounted on one end wall of the housing which has an opening therein communicating between the plenum chamber and the blast tube. A fuel nozzle and ignition electrodes are positioned in the blast tube and extend into the plenum chamber. A squirrel cage blower is provided including a scroll casing with an air discharge end mounted on a side wall of the housing which has an opening therein communicating between the plenum chamber and the air discharge end of the casing. A shaded pole motor is mounted on the casing and is operatively connected to drive the blower. An electrically operated fuel pump is mounted on the housing, and an ignition transformer or solid-state ignitor is also mounted on the housing and has secondary terminals which extend into the plenum chamber and are connected to the ignition electrodes. A solenoid-actuated valve connects the fuel pump to the nozzle, and a speed-responsive switch is mounted on and operated by the motor and is coupled to energize the valve in response to motor operation. A flame detector in the plenum chamber is exposed to the blast tube, and means responsive to the flame detector is coupled to de-energize the ignition transformer in response to ignition of fuel.

10 Claims, 6 Drawing Figures

FIG. 1
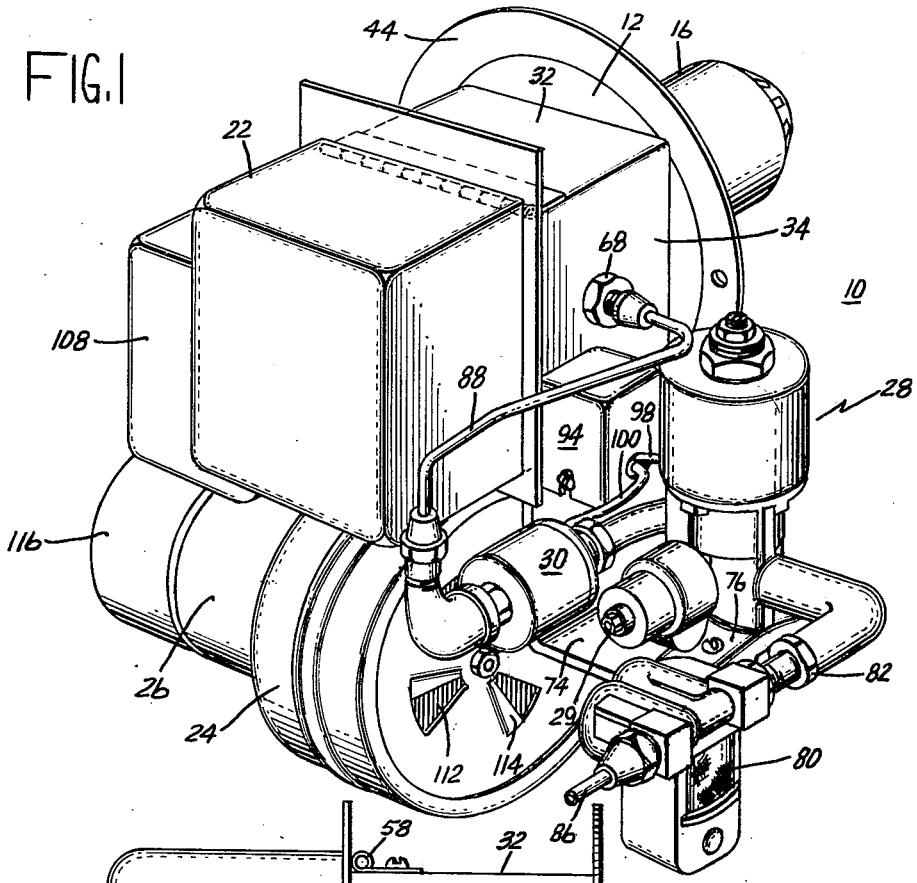
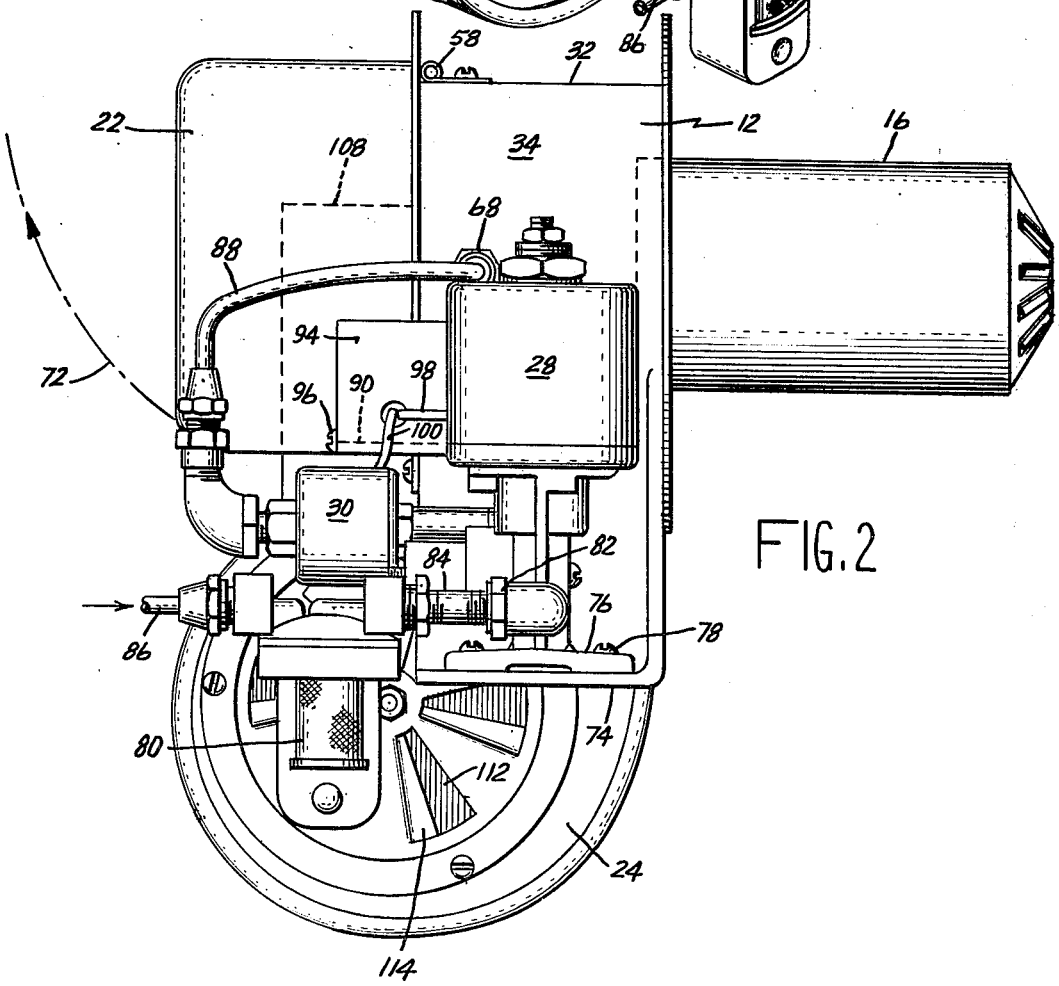
FIG. 2

ENERGY-EFFICIENT OIL BURNER

BACKGROUND OF THE INVENTION

1. Field of the Invention

This invention relates generally to generally to gun-type oil burners, and more particularly to an energy-efficient gun-type oil burner.

2. Description of the Prior Art

Conventional gun-type oil burners, including those manufactured by the assignee of the present application, incorporate a split-phase induction motor driving a squirrel cage blower having a scroll casing communicating directly with the blast tube. In such conventional oil burners, a gear pump driven by the motor supplies oil under pressure to the nozzle of the burner, and an ignition transformer is mounted on a part of the blower casing thus detracting from a true scroll configuration. Still further, in such conventional gun-type oil burners, the ignition transformer is coupled to the ignition electrodes at all times thereby providing ignition sparking during normal operation of the burner.

In conventional oil burners, the provision of a motor-driven oil pump necessitates use of a split-phase motor thus involving greater initial cost and greater energy consumption than would be involved by the use of a shaded pole motor to drive the blower alone. Gun-type gas burners, which do not require a fuel pump, have employed shaded pole motors for driving the blower. I am aware that gun-type oil burners have recently been introduced abroad employing an electrically-actuated fuel pump thus permitting use of a shaded pole motor to drive the blower.

The provision of a plenum chamber located between the blower and the blast tube provides even air flow to the blast tube thus reducing burner noise, and the use of a blower having a near-perfect scroll casing improves the air delivery efficiency thus reducing the energy consumption of the motor. Certain prior gun-type gas burners have employed a near-perfect blower casing scroll and plenum chamber. It is also known to de-energize the ignition transformer during normal burner operation thereby reducing energy consumption.

The present-day energy shortage makes desirable the provisin of an energy-efficient gun-type oil burner; however, to the best of my knowledge, the above-referred to energy-conserving features variously employed in prior gun-type oil and gas burners have not been combined to provide a gun-type oil burner which is highly conservative of energy, both electrical and fossil. It is further desirable to provide a gun-type oil burner capable of operation with minimum fuel flow, as for example for providing minimal winter heating in a summer home, or for use in small mobile homes and the like.

SUMMARY OF THE INVENTION

In its broader aspects, the invention provides a gun-type oil burner comprising a housing having side and end walls defining a plenum chamber. A blast tube is provided mounted on one end wall of the housing which has an opening therein communicating between the plenum chamber and the blast tube. A fuel nozzle and ignition electrodes are positioned in the blast tube and extend into the plenum chamber. A squirrel cage blower is provided including a scroll casing with an air discharge end mounted on the side wall of the housing which has an opening therein communicating between the plenum chamber and the air discharge end of the casing. A shaded pole motor is provided mounted on the casing and operatively connected to the blower, and an electrically operated fuel pump is provided mounted on the housing and connected to the nozzle for supplying fuel thereto. An ignition voltage source such as an ignition transformer or solid-state ignitor is provided mounted on the housing and having secondary terminals extending into the chamber and connected to the electrodes.

In the preferred embodiment, a solenoid-actuated valve is provided connecting the fuel pump to the nozzle, and a speed-responsive switch is provided mounted on and operated by the motor and coupled to energize the valve in response to motor operation. The preferred embodiment also includes a flame detector in the plenum chamber and exposed to the blast tube, and means responsive to the flamed detector coupled to de-energize the ignition transformer in response to ignition of fuel at the nozzle. In the preferred embodiment, the housing is a one-piece casting.

It is accordingly an object of the invention to provide an improved, energy-efficient, gun-type oil burner.

Another object of the invention is to provide an improved, low-cost, energy-efficient gun-type oil burner.

A further object of the invention is to provide a low cost, energy-efficient, quiet gun-type oil burner capable of operating at a low fuel flow rate.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a perspective view of the improved energy-efficient oil burner of the invention;

FIG. 2 is a side view of the oil burner of FIG. 1;

DESCRIPTION OF THE PREFERRED EMBODIMENT

Figure 3:
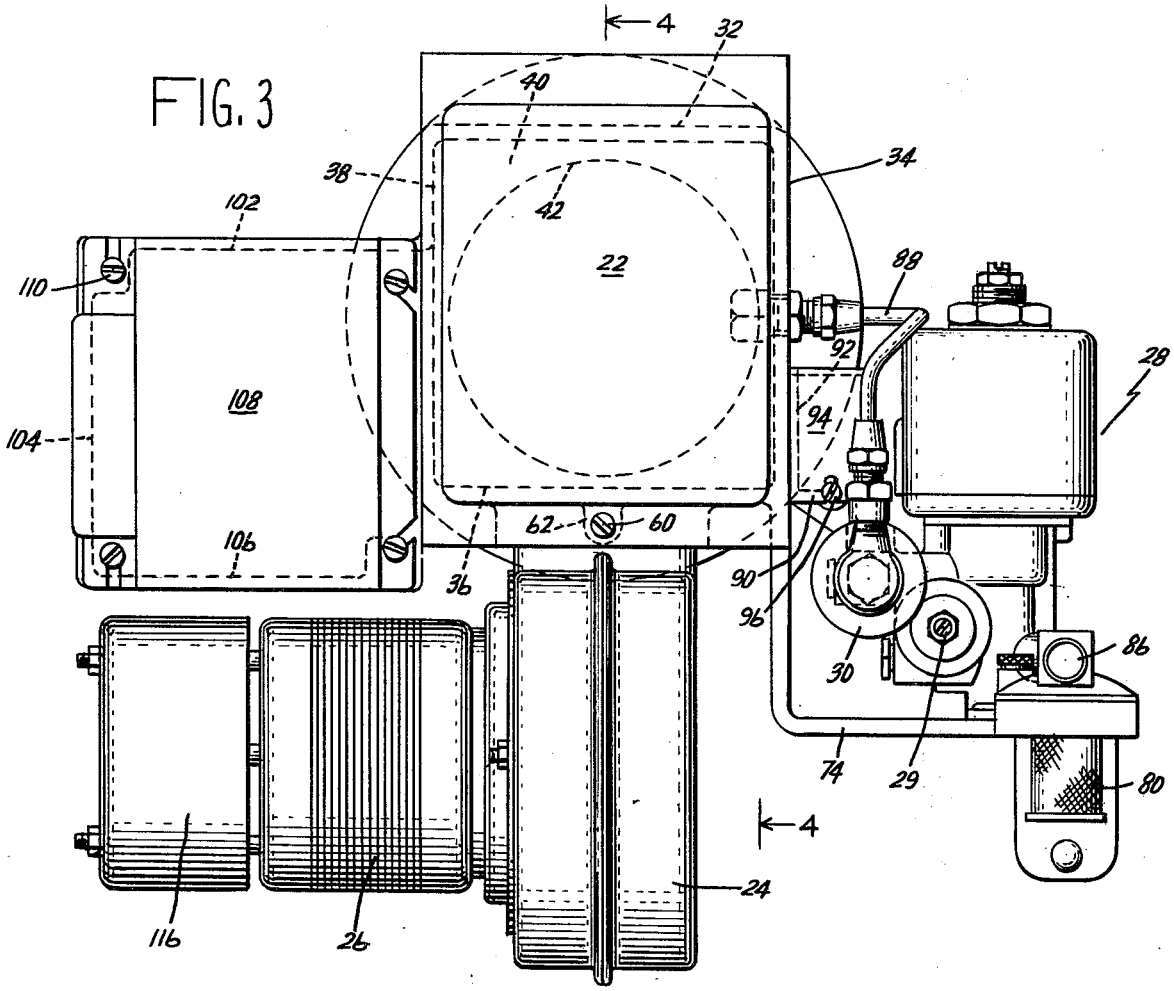
FIG. 3 is a rear-end view of the oil burner of FIG. 1.
Figure 4:
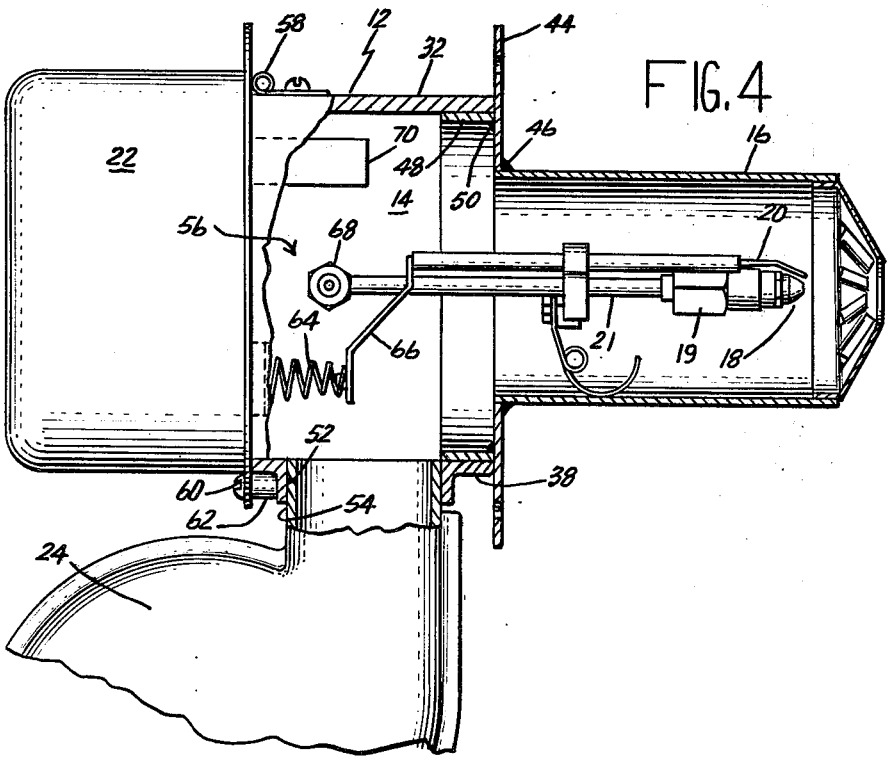
FIG. 4 is a fragmentary cross-sectional view taken generally along the line 4—4 of FIG. 3.

Referring now to FIGS. 1–4 of the drawings, there is shown, generally indicated at 10, a gun-type comprising housing 12 which defines plenum chamber 14 (FIG. 4), blast tube 16 mounted on housing 12 and having conventional fuel nozzle 18 and ignition electrodes 20 positioned therein and extending into plenum chamber 14, ignition voltage source 22, such as an ignition transformer or solid-state ignitor mounted on housing 12, a squirrel cage blower having scroll casing 24 mounted on housing 12, shaded pole motor 26 mounted on blower casing 24 and operatively connected to drive the blower in conventional fashion, and electrically-actuated fuel pump 28 and solenoid fuel valve 30, both also mounted on housing 12.

Housing 12 preferably is a one-piece casting having side walls 32, 34, 36, 38, and a front wall 40 having opening 42 therein. Blast tube 16 is joined to conventional mounting flange 44, as by welding at 46, and annular flange 48 joined to mounting flange 44, as by welding at 50, is press-fitted in opening 42 in housing end wall 40 (FIG. 3) thus providing communication between plenum chamber 14 and blast tube 16. Side wall 38 has opening 52 therein and discharge end 54 of blower casing 24 is press-fitted in opening 52 thereby providing communication between blower casing 24 and plenum chamber 14.

Side walls 32, 34, 36 and 38, and end wall 40 define an open end 56 for plenum chamber 14. Ignition voltage source 22 is hingedly mounted on side wal 32 of housing 12, as at 58 and normally closes opening 56 to complete plenum chamber 14. Ignition voltage source 22 is retained in its normal position by threaded fastener 60 threadedly engaging boss 62 on side wall 36 of housing 12. Conventional spring contracts 64 connected to the secondary terminals of ignition voltage source 22 cooperatively engage contacts 66 on ignition electrodes 20. Nozzle 18 is connected by adapter 19 and oil tube 21 to a fitting 68 in side wall 34 of housing 12. Flame detector 70 is mounted on ignition voltage source 22 and is normally positioned in plenum chamber 14 to be exposed to blast tube 16 so as to detect flame at nozzle 18. Ignition voltage source 22 may be moved away easily from its normal position, as shown at 72 in FIG. 2, thereby to permit access to plenum chamber 14 and blast tube 16 for servicing the nozzle and electrode assembly.

Housing 12 has shelf portion 74 integrally joined to side wall 34 of housing 12. Electrically-actuated fuel pump 28 includes mounting foot 76 supported on shelf 74 and secured thereto, as by threaded fasteners 78. Conventional oil strainer 80 is connected to fuel inlet 82 of fuel pump 28 by pipe section 84, and has oil supply line 86 adapted to be connected thereto. Conventional solenoid valve 30 is connected to the fuel discharge of pump 28. Fuel supply line 88 couples solenoid valve 30 to fitting 68 on housing 12. Electrically-actuated fuel pump 28 is preferably of the solenoid-actuated type, such as Model No. MG5 manufactured by Taisan Industrial Co., Ltd. of Tokyo, Japan. Pump 28 includes pressure and fuel flow rate adjustment 29. Housing 12 may be inverted and pump 28 mounted on the resulting upper side of shelf portion 74.

Bottom and side walls 90, 92 are also integrally formed on side wall 34 of housing 12 and, with removable cover 94 secured to wall 90 by threaded fastener 96, from an electrical junction box for making electrical connections to fuel pump 28 and solenoid valve 30, as at 98, 100.

Walls 102, 104 and 106, along with a rear wall (not shown) integrally formed on side wall 38 of housing 12 define a box for accommodating the primary control for burner 10 which is mounted on cover plate 108 secured to walls 102, 104, 106 by suitable threaded fasteners 110. Blower housing 24 has conventional air inlet openings 112 and adjustable damper 114 controlling the volume of air entering the blower.

Figure 5:
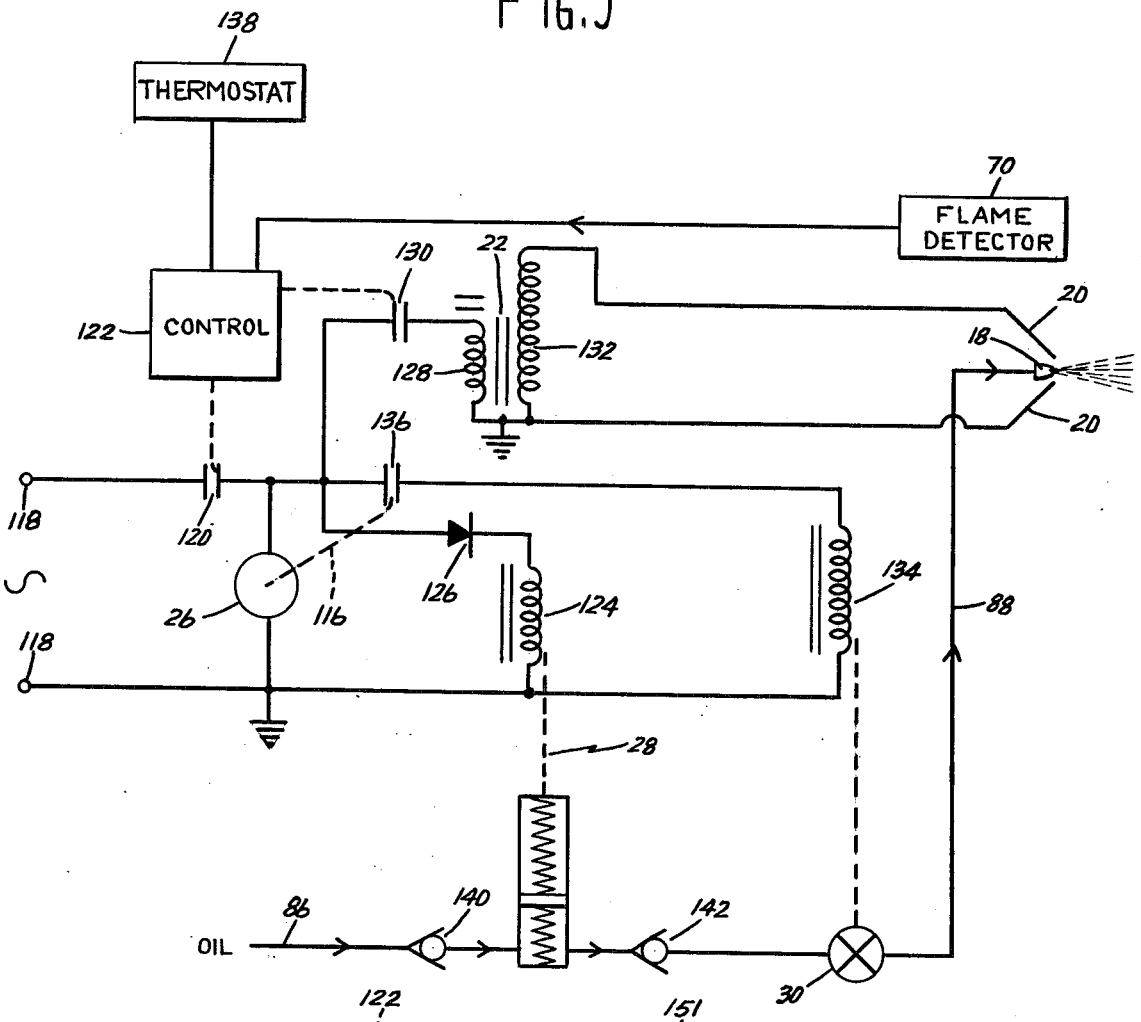
FIG. 5 is a schematic view showing the electrical system of the oil burner of the invention.

Referring now additionally to FIG. 5, shaded pole motor 26 has conventional centrifugal switch mechanism 116 mounted thereon and operative thereby. Shaded pole motor 26 is coupled across terminals 118 of a source of single-phase alternating current of appropriate voltage and frequency by contacts 120 operated by primary control 122. Fuel pump 28 is operated by solenoid 124 coupled across motor 26 by diode 126 and thus, pump 28 is energized along with shaded pole motor 26 when contacts 120 are closed by control 122. Primary winding 128 of ignition transformer 22 is coupled across motor 26 by contacts 130 also operated by primary control 122. Secondary winding 132 of ignition transformer 22 is coupled to ignition electrodes 20. solenoid-actauted valve 30 is actuated by a solenoid 134 connected across motor 26 by contacts 136 of centrifugal mechanism 116.

It will now be seen that when thermostat 138 calls for heat, primary control 122 closes contacts 120 and 130 thereby coupling shaded pole motor 26, primary winding 128 of ignition transformer 22, and solenoid 124 of fuel pump 28 across line 118. When motor 26 comes up to speed thereby to deliver the desired air flow to plenum chamber 14, centrifugal switch 116 closes contacts 136 thereby to energize solenoid 134 of valve 30 so that fuel is supplied from line 86 through check valves 140, 142 to nozzle 18. Flame detector 70 senses flame at nozzle 18 and actuates control 122 to open contacts 130 thereby to de-energize ignition transformer 22 to terminate the ignition spark at ignition electrodes 20.

Figure 6:
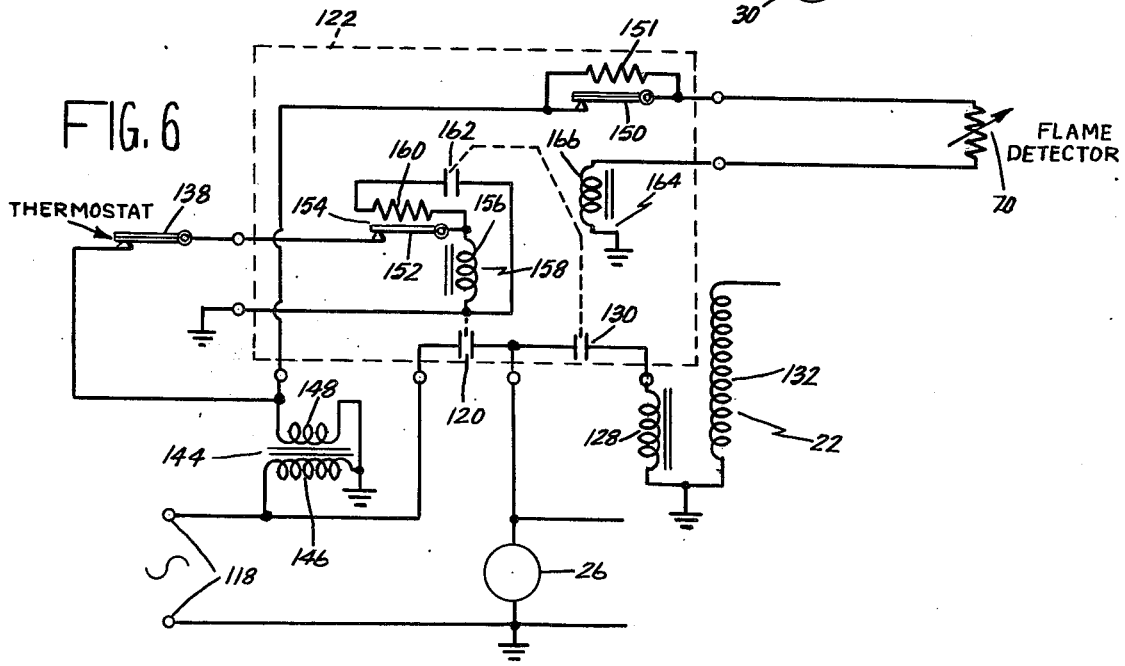
FIG. 6 is a schematic view showing one primary control system which may be employed with the oil burner of the invention.

Referring now additionally to FIG. 6, one form of primary control 122 for oil burner 10 will be described. Transformer 144 has its primary winding 146 coupled across line 118 and its low-voltage secondary winding 148 is coupled to thermostat 138 and to bimetal switch 150 coupled in series with flame detector 70, which preferably is a cadmium sulfide cell. Theremostate 138 is coupled in series with bimetallic element 152 of conventional time delay lock-out device 154, and with operating coil 156 of relay 158 which operates contacts 120. Heater 160 of time delay and lock-out device 154 is connected across operating coil 156 of relay 158 by contacts 162 of relay 164, which also operates contacts 130. Bimetallic elememt 150 and flame detector 70 are coupled in series with operating coil 166 of relay 164.

It will now be seen that when thermostat 138 calls for heat, operating coil 156 of relay 158 will initially be energized thereby closing contacts 120 to energize shaded pole motor 26. Operating coil 166 of relay 164 is also energized through bimetallic element 150 and flame detector 70 thereby to close contacts 130 to energize primary winding 128 of ignition transformer 22. Contacts 162 are also close to energize heater 160 of time delay and lock-out device 154. In the event that flame detector 70 senses the presence of flame at nozzle 18, thus lowering the resistance of flame detector 70, the increased current flow through heater 151 will shortly cause bimettalic element 150 to open its contacts thereby to de-energize operating coil 166 of relay 164, thus opening 130 to de-energize primary winding 128 of ignition transformer 22. Contacts 162 of relay 164 are opened at the same time thus de-energizing heater 160 so that bimetallic element 152 maintains it contacts closed, operating coil 156 of relay 158 thus remaining energized to maintain contact 120 closed for continued energization of shaded pole motor 26, fuel pump 28 and valve 30. When thermostat 138 no longer calls for heat thus opening its contacts, operating coil 156 is de-energized thus opening its contacts 120 to de-energize shaded pole motor 26.

In the event that thermostat 138 calls for heat but, for some reason, there is no ignition, the resistance of cadmium sulfide flame detector 70 remains high so that bimetallic 150 does not open its contacts so that operating coil 166 of relay 164 remains energized maintaining its contacts 162 closed. The resultant current flowing through heater 160 thus causes bimetallic 152 to open its contacts after a predetermined time delay thereby de-energizing operating coil 156 of relay 158 and opening its contacts 120 de-energizing motor 26 and ignition transformer 22. After another predetermined time delay, bimetallic element 152 again closes its contacts thereby again energizing operating coil 156 of relay 158 to close its contacts 120 to again energize motor 26 and ignition transformer 22 so as to provide another effort to secure ignition. If ignition is obtained, the operation proceeds as described above. However, if ignition is not obtained, bimetallic element 152 of time delay and lock-out device 154 again opens to de-energize the system. Device 154 is preferably of the commercially available type which cycles once and then locks-out upon the second unsuccessful attempt at ignition.

It will now be seen that the improved low energy gun-type oil burner of the invention has reduced electrical consumption by virtue of the shaded-pole blower motor, an electrical pump rather a direct-drive gear pump, and interrupted rather than continuous ignition which, in turn, permits the use of a smaller and thus less costly ignition transformer since a continuous duty rating is not required. Further, the use of a near-perfect scroll blower casing, which is permitted by eliminating the customary mounting of the transformer on the blower casing, along with the plenum chamber, provides maximum air delivery and maximum static pressure with minimum power input to the blower. Still further, the use of plenum chamber provides an even flow of air in the blast tube thus greatly reducing the noise customarily associated with gun-type burners. Importantly, by reason of the even air delivery to the blast tube which, in turn, provides excellent combustion, the improved gun-type oil burnner of the invention will fire at very low fuel flow rates, e.g., as low as 0.3 GPH.

It will further be observed that the integral housing 12 is a simple one-peice die casting which requires no machining and that all remaining components of the oil burner are sub-assemblies which are mounted on housing 12, i.e., blower 24, motor 26 and centrifugal switch 116; pump 28, valve 30 and strainer 80; nozzle 18 and electrodes 20; blast tube 16; transformer 22; and control 122.

In a specific embodiment of the invention for use with 120 volt, single phase, 60 Hertz alternating current a 2-pole, 3000 RPM, 0.016 Hp shaded pole motor was employed, blower 24 was capable of delivering 48.8 CFM at 3000 RPM, at a maximum fuel flow rate of 1.25 GPH, the power comsumption was 105 watts at 1.36 amperes vis-a-vis 275 watts at 5.1 ampers in the case of a conventional gun-type oil burner at the same fuel flow rate, and at the minimum fueld flow rate of 0.3 GPH, the power consumption was 99 watts at 1.26 amps. In that embodiment, the open circuit secondary voltage of ignition of transformer 22 was 10,000 volts.

While there have been described above the principles of this invention in connection with specific apparatus, it is to be clearly understood that this description is made only by way of example and not as a limitation to the scope of the invention.

What is claimed is:

1. A gun-type oil burner comprising: a housing having side and wall ends defining a plenum chamber; a blast tube mounted on one end wall of said housing, said one end wall having an opening therein communicating between said chamber and blast tube; a fuel nozzle and ignition electrodes in said blast tube and extending into said chamber; a squirrel cage blower including a scroll casing with an air discharge end mounted on said side wall of said housing, said side wall having an opening therein communicating between said chamber and air discharge end of said casing; a shaded pole motor mounted on said casing and operatively connected to said blower; a solenoid-operated fuel pump mounted on said housing and connected to said nozzle for supplying fuel thereto; and an ignition voltage source mounted on said housing and having secondary terminals extending into said chamber and connected to said electrodes.

2. The oil burner of claim 1 wherein said housing is integrally formed.

3. The oil burner of claim 1 futher comprising a solenoid-activated valve connecting said fuel pump to said nozzle, and a speed-responsive switch mounted on and operated by said motor and coupled to said valve to energize the same in response to motor operation.

4. The oil burner of claim 1 wherein one of said housing walls has another opening therein, said source being hingedly connected to said housing and having a normal position closing said last-nammed opening and forming an end wall thereof opposite said one end wall and blast tube.

5. The oil burner of claim 4 further comprising a flame detector mounted on said source and being disposed in said chamber and exposed to said blast tube in said normal position of said source, and means responsive to said flame detector coupled to de-energize said source in response to ignition of fuel at said nozzle.

6. The oil burner of claim 1 wherein said housing is a one-piece casting having four side walls mutually defining a rectangle and one end wall defining with said side walls an open end opposite said end wall, said blast tube being mounted on said one end wall, said blower casing end being connected to one of said side walls, said source being hingedly connected to another side wall opposite said one side wall and having a normal position closing said housing open end thereby to form said plenum chamber, said housing including a shelf portion integrally joined to and extending outwardly from a third one of said side walls, said pump being mounted on said shelf portion.

7. The oil burner of claim 6 further comprising a speed-responsive switch mounted on and operated by said motor, a solenoid-actuated valve connecting said fuel pump to said nozzle, said switch being electrically coupled to said valve to energize the same in response to motor operation, and a flame detector disposed in said chamber and exposed to said blast tube and control means responsive to said flame detector and coupled to de-energize said source in response to ignition of fuel at said nozzle.

8. The oil burner of claim 7 wherein said housing includes an open-ended box portion integrally joined to and extending outwardly from the side wall opposite said third side wall for accommodating the primary control for said oil burner.

9. The oil burner of claim 7 wherein said housing includes another open-ended box portion integrally joined to and extending outwardly from said third side wall for accommodating electrical connections to said pump and valve.

10. The oil burner of claim 9 wherein said pump is of the solenoid-actuated piston-type.

* * * * *

UNITED STATES PATENT AND TRADEMARK OFFICE

CERTIFICATE OF CORRECTION

PATENT NO. : 4,140,476

DATED : February 20, 1979

INVENTOR(S) : Robert A. Kaplan

It is certified that error appears in the above-identified patent and that said Letters Patent are hereby corrected as shown below:

In the Abstract, line 1, --oil-- should be inserted ahead of "burner".
Col. 1, line 6, "generally to" (second appearance) should be deleted.
Col. 1, line 45, "provisin" should be --provision--.
Col. 2, line 18, "flamed" should be --flame--.
Col. 2, line 52, --oil burner-- should be inserted ahead of "comprising".
Col. 3, line 11, "wal" should be --wall--.
Col. 3, line 16, "contracts" should be --contacts--.
Col. 4, line 4, "solenoid-actauted" should be --Solenoid-actuated--.
Col. 4, line 27, "Theremostate" should be --Thermostat--.
Col. 4, line 34, "elememt" should be --element--.
Col. 4, line 43, "close" should be --closed--.
Col. 4, line 48, "bimettalic" should be --bimetallic--.
Col. 4, line 50, --contacts-- should be inserted after "opening".
Col. 4, line 53, "it" should be --its--.
Col. 4, line 55, "contact" should be --contacts--.
Col. 4, line 58, --of relay 158-- should be inserted after "156".

UNITED STATES PATENT AND TRADEMARK OFFICE

CERTIFICATE OF CORRECTION

PATENT NO. : 4,140,476

DATED : February 20, 1979

INVENTOR(S) : Robert A. Kaplan

It is certified that error appears in the above-identified patent and that said Letters Patent are hereby corrected as shown below:

Col. 5, line 33, "burnner" should be --burner--.
Col. 5, line 37, "one-peice" should be --one-piece--.
Col. 5, line 47, "48.8" should be --46.8--.
Col. 5, line 49, "comsumption" should be --consumption--.
Col. 5, line 52, "fueld" should be --fuel--.

Claim 1, col. 5, line 63, "and wall ends" should be --and end walls--.
Claim 3, col. 6, line 15, "activated" should be --actuated--.
Claim 4, col. 6, line 22, "nammed" should be --named--.

Signed and Sealed this

Nineteenth Day of June 1979

[SEAL]

Attest:

RUTH C. MASON
Attesting Officer

DONALD W. BANNER
Commissioner of Patents and Trademarks